US011498753B2

(12) United States Patent
Kyte

(10) Patent No.: US 11,498,753 B2
(45) Date of Patent: Nov. 15, 2022

(54) COLLAPSIBLE CONTAINER

(71) Applicant: ICF SA, Lugano (CH)

(72) Inventor: Eric Alfred Kyte, Petaling Jaya (MY)

(73) Assignee: ICF SA, Lugano (CH)

( * ) Notice: Subject to any disclaimer, the term of this patent is extended or adjusted under 35 U.S.C. 154(b) by 27 days.

(21) Appl. No.: 16/755,596

(22) PCT Filed: Oct. 10, 2018

(86) PCT No.: PCT/MY2018/050067

§ 371 (c)(1),
(2) Date: Apr. 12, 2020

(87) PCT Pub. No.: WO2019/074356

PCT Pub. Date: Apr. 18, 2019

(65) Prior Publication Data

US 2021/0198032 A1 Jul. 1, 2021

(30) Foreign Application Priority Data

Oct. 11, 2017 (MY) ..... PI2017001509

(51) Int. Cl.
*B65D 88/52* (2006.01)

(52) U.S. Cl.
CPC ..... *B65D 88/524* (2013.01)

(58) Field of Classification Search
CPC .... B65D 88/524; B65D 88/522; B65D 88/52; B65D 88/121; B65D 88/005; B65D 90/005
USPC ..... 220/1.5, 4.28, 4.29, 6, 666
See application file for complete search history.

(56) References Cited

U.S. PATENT DOCUMENTS

| | | | | |
|---|---|---|---|---|
| 2,782,955 A | | 2/1957 | Gordon | |
| 3,799,384 A | * | 3/1974 | Hurkamp | B65D 88/522 220/6 |
| 2010/0018967 A1 | * | 1/2010 | Schrayvogel | B65D 88/522 220/6 |
| 2014/0144920 A1 | | 5/2014 | Meijers | |

FOREIGN PATENT DOCUMENTS

| | | | | |
|---|---|---|---|---|
| CN | 203359247 | * | 12/2013 | B65D 88/52 |
| WO | 2009034142 | | 3/2009 | |
| WO | WO2015195069 | | 12/2015 | |

* cited by examiner

*Primary Examiner* — Don M Anderson
*Assistant Examiner* — Elizabeth J Volz
(74) *Attorney, Agent, or Firm* — Head, Johnson, Kachigian & Wilkinson, PC

(57) ABSTRACT

A collapsible container wherein the left side panel is hingedly connected to the top panel and includes at least one strut, one end of the strut being pivotally connected at an intermediate point along the end edge of the left panel, the other end of the strut being pivotally connected to the bottom panel; the right side panel being hingedly connected to the bottom panel and includes at least one strut, one end of the strut being pivotally connected at an intermediate point along the end edge of the side panel, the other end of the strut being pivotally connected to the top panel, such that the container is moveable between a collapsed configuration and an erect configuration, wherein the struts maintain a spaced apart relationship between the edges of the hingedly connected panels and the respective top or bottom panel during such movement.

14 Claims, 7 Drawing Sheets

Figure 5a
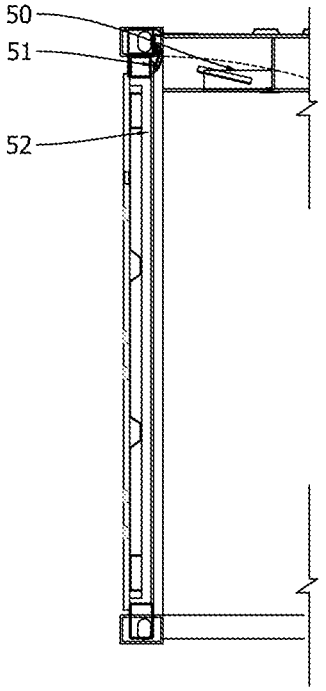
Figure 5b
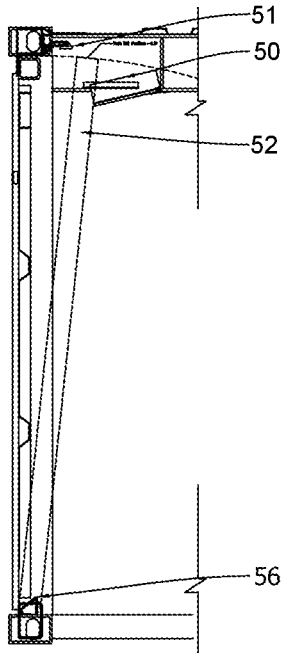
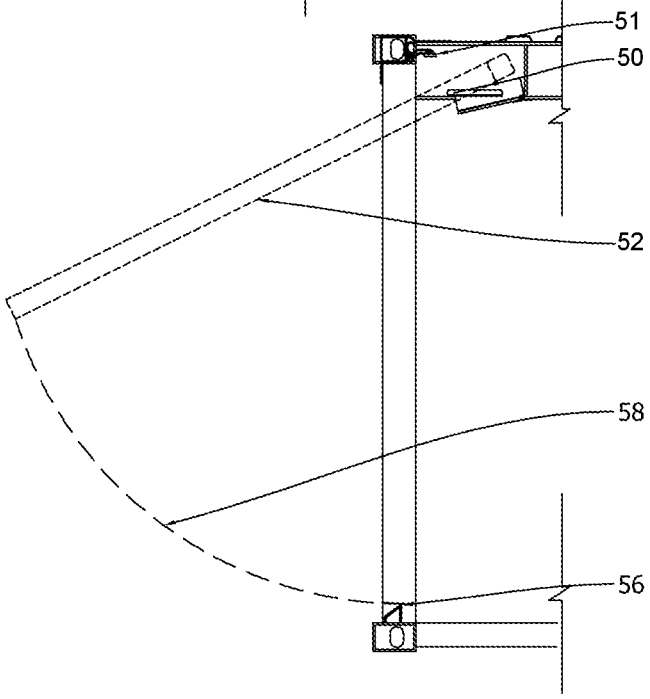
Figure 5c

Figure 5d
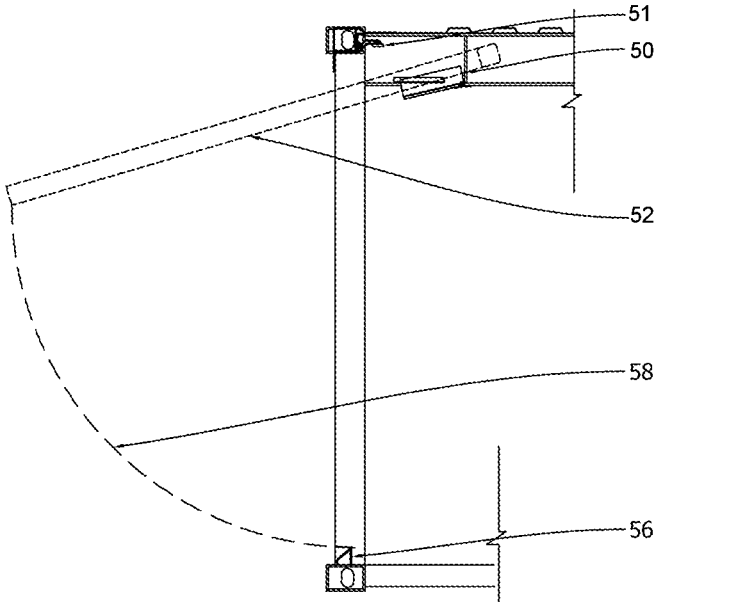
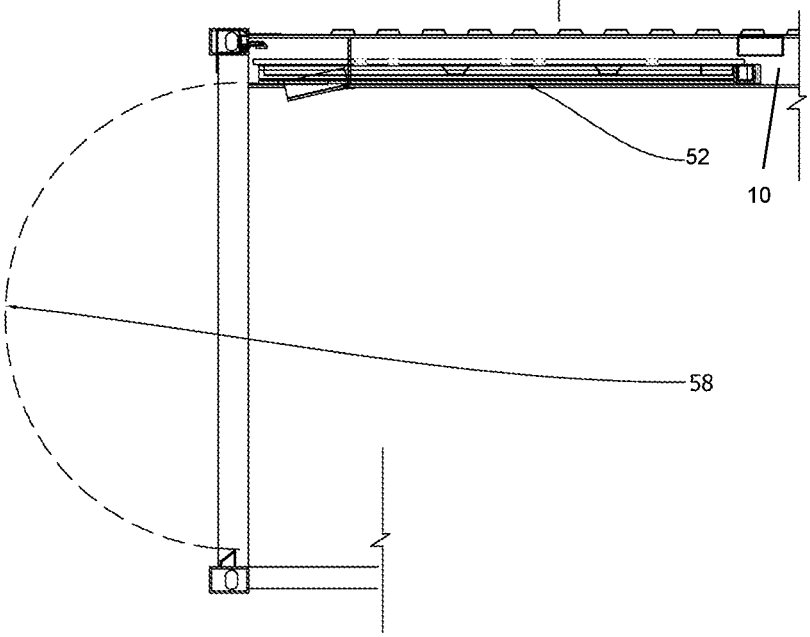
Figure 5e

COLLAPSIBLE CONTAINER

FIELD OF INVENTION

The invention relates to a collapsible container, in particular, but not necessarily limited to a collapsible freight container.

BACKGROUND

Freight containers are often used for transporting items between different locations, or holding the items when storage. Intermodal containers in particular are standardised shipping containers used by different modes of transport (e.g. rail, truck, ship) across the world. Most are durable steel boxes with standard lengths of either 6 m or 12 m. As the containers are standardised they can be easily and efficiently handled, moved or stacked. The main standards for intermodal containers are as follows:

ISO 668 Series 1 freight containers-classification, external dimensions and ratings;

ISO 1161 Series 1 freight containers-corner fittings-specification; and

ISO 1496-1 Series 1 freight containers-specification and testing—Part 1: General cargo containers.

However, when a container is transported to a destination, it may not be used for a return journey until there are sufficient goods intended to be transported to the origin. Alternatively the container could be returned empty, but an empty container takes up the same amount of space as a full container, and thus the cost for transporting an empty container as about the same as a full container but without any revenue. In either case, this is a waste of resources.

In an effort to reduce storage and transportation costs of empty containers, collapsible containers have been developed.

For example in EP2389328 there is described a container where the side walls fold inwards so that when fully collapsed, the container is a third of the height of the erect container. Thus three empty collapsible containers can be substituted for a standard empty container, and stacked in a similar manner.

However, one of the problems is that a fork lift truck has to inserts its prongs into the slots of the top panel when in a collapsed configuration and lift the same to erect the container. The end panels are typically then pivoted up from their storage position lying flat on the bottom panel to lock the structure into place. This presents a safety risk, as a person has to enter the container to start raising the end panel while the fork lift truck is holding up the top panel, which could collapse on the person during this operation.

In addition, because the side panels fold along the top edge, bottom edge, and across the centre, there are lines of weakness along the hinges which potentially reduce the structural integrity, and increases the risk of water leaks. Furthermore the hinges require maintenance such as oiling, and if dust or water seeps in, rust and/or friction may build up. There are stringent regulations for freight containers, and they must pass tests for structural strength, compressive and tensile loads, and water proofing. As such the container in this example is more likely to fail the tests compared to a standard container.

Yet further, the container is around 40% heavier than a non-folding container, which increases the difficulty and cost of handling and transporting the same.

An alternative container is illustrated in U.S. Pat. No. 8,196,766, where instead of folding, the side walls are hingedly connected along one longitudinal edge, the other longitudinal edge being provided with rollers which run along grooves in the floor or roof. An advantage of this design is that it is more compact, whereby four collapsed containers can fit in the space of one erect container.

However, a problem with this design is that it is very easy for dirt or stones to get into one or more of the grooves, which would then prevent the rollers from functioning. In addition, any damage to such a specialised mechanism would be difficult and expensive to repair, and regular maintenance would be required. Furthermore the international standards for containers require the floor to be flat, and thus the presence of grooves mean that this container does not meet the requirements.

An aim of the invention therefore is to provide a collapsible container which overcomes the above issues.

SUMMARY OF INVENTION

In an aspect of the invention, there is provided a collapsible container comprising:

a pair of side panels, a pair of end panels, a top panel and a bottom panel;

the container being movable between an erect configuration in which the side panels and end panels are in a substantially perpendicular plane to the top and bottom panels, and a collapsed configuration in which the side panels and end panels are in a substantially parallel plane to the top and bottom panels;

characterised in that at least one of the pairs comprises hingedly connected panels, a first panel being hingedly connected to the top panel and includes at least one strut, one end of the strut being pivotally connected at an intermediate point along the end edge of said first panel, the other end of the strut being pivotally connected to the bottom panel, a second panel being hingedly connected to the bottom panel and includes at least one strut, one end of the strut being pivotally connected at an intermediate point along the end edge of said second panel, the other end of the strut pivotally connected to the top panel;

such that when the container is moved between the collapsed configuration and the erect configuration, the struts maintain a spaced apart relationship between the edges of the hingedly connected panels and the respective top or bottom panel.

Typically the hingedly connected pair of panels are the side panels. Advantageously the side panels are moved into the erect configuration without touching the top or bottom panels, so are unhindered by any debris that may be present. In addition there is no horizontal deflection of the top or bottom panels during this movement.

In one embodiment each panel is maintained in a planar form when moved between erect and collapsed configurations. In other words, the panels do not have hinges to allow them to be folded themselves. This ensures that the container is lightweight as additional mechanisms for folding the panels in half are not required.

In one embodiment a strut is provided at both ends of the hingedly connected panels. This provides support and guidance at the ends of the panels as they are lowered and raised between configurations, without compromising the integrity of the panel.

In one embodiment the hingedly connected panels are connected to the top or bottom panels via clevis pin hinges. Advantageously this allows the connected panel to pivot as a single rigid unit. The clevis pin hinges can be two-leaf, four-leaf, or other-leaf, and are typically provided adjacent the end of the side panels i.e. they do not need to extend along the length of the side panel, which saves weight and maintenance.

In one embodiment the end panels can be slid or rolled into position between an erect configuration in which they are in a perpendicular plane to the top, bottom, and side panels, and a storage configuration in which they are in substantially the same plane as the top or bottom panel. Typically the end panels lie flat against or adjacent the top or bottom panel in the storage configuration.

In one embodiment the end panels maintain the side panels in position when they are in the erect configuration. Advantageously once the end panels have started to swing into the erect position, the container is prevented from collapsing as this would require an inward movement by the side panels, prevented by the presence of the end panel in the movement arc.

In one embodiment the top and/or bottom panels are provided with a recess or receiving area in which the end panels may be stored.

In one embodiment at least one end panel is provided with doors through which access to the container may be granted when in the erect configuration. Typically the doors are lockable.

In one embodiment at least one end panel comprises a roller shutter, which can be opened or closed to respectively provide or prevent access to the container.

In one embodiment, the sides of the container are provided with spacers to ensure that the side panels can lie flat in the collapsed configuration.

In one embodiment, fork lift pockets are provided in the top panel to allow a fork lift truck to raise and lower the same to move the container between erect and collapsed configurations respectively. Typically fork lift pockets are provided in the bottom panel to allow a fork lift truck to lift and/or relocate the container.

In one embodiment four containers in the collapsed configuration can be stacked to substantially equate to the same space as one container in the erect configuration Advantageously these can be substituted so that stacking configurations in ships and warehouses are not significantly affected.

In one embodiment four containers in the collapsed configuration can be locked together so that they can be moved and relocated in the same way as a single container.

In one embodiment the struts may be provided with hydraulic systems to allow the panels to be raised and/or lowered in a controlled fashion. Advantageously this provides additional safety such that if the fork lift truck prongs slip, the top panel falls in a slow controlled fashion rather than in a fast and potentially dangerous manner.

It will be appreciated that typically the side panels are hingedly connected whereas the end panels slide or roll into position, but an alternative configuration may also be provided where the end panels are hingedly connected and the side panels slide or roll into position mutatis mutandis.

BRIEF DESCRIPTION OF DRAWINGS

It will be convenient to further describe the present invention with respect to the accompanying drawings that illustrate possible arrangements of the invention. Other arrangements of the invention are possible, and consequently the particularity of the accompanying drawings is not to be understood as superseding the generality of the preceding description of the invention.

FIG. 5 is a schematic partial side view of the end panel (a) in an erect configuration; (b-d) being moved to; (e) a storage configuration.

DETAILED DESCRIPTION

Figure 1A:
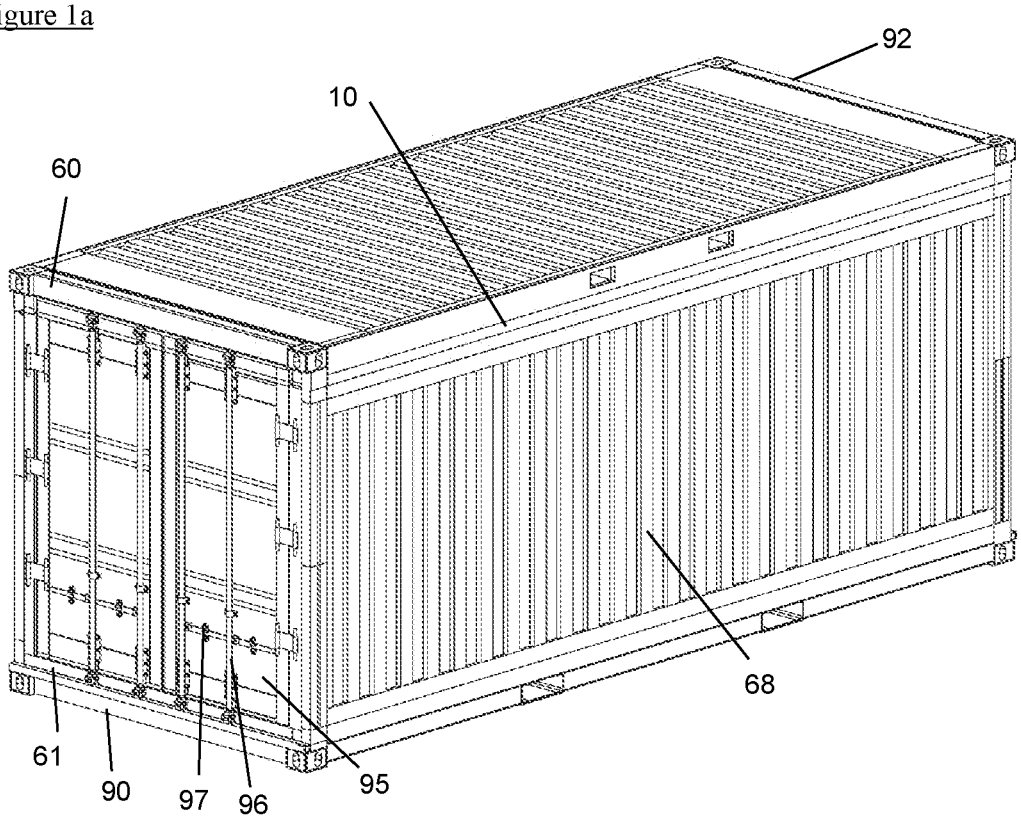
FIG. 1 is an isometric view of a container according to an embodiment of the invention (a) in an erect configuration; (b) in a partially collapsed configuration; and (c) in a collapsed configuration.
Figure 1B:
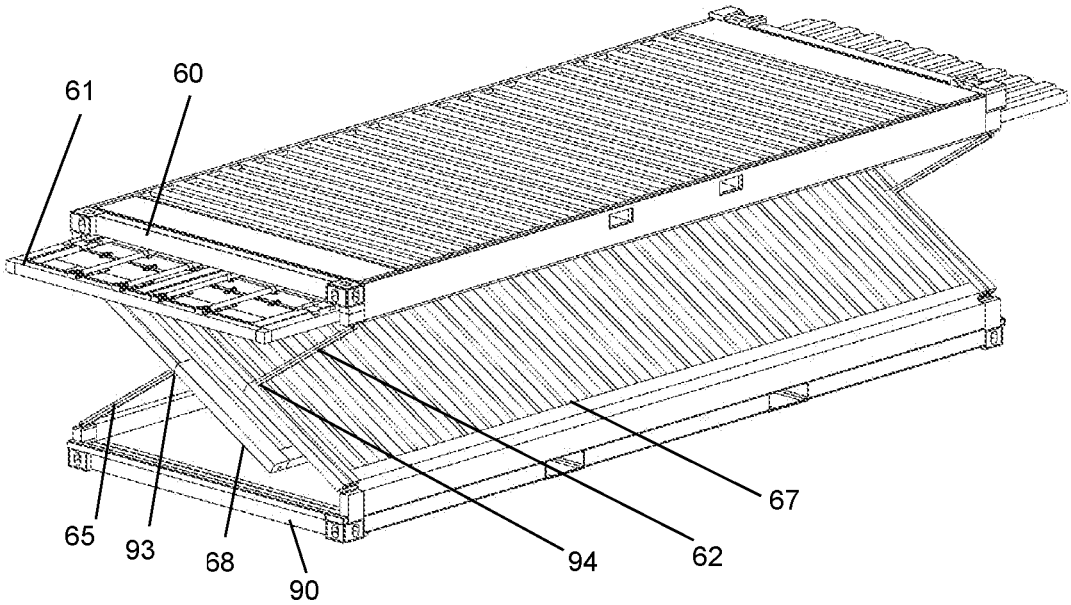
Figure 1C:
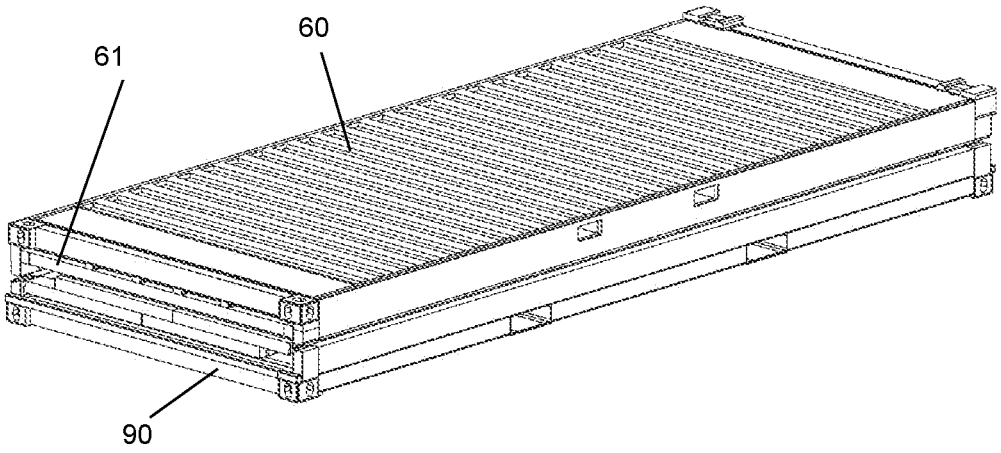
Figure 2A:
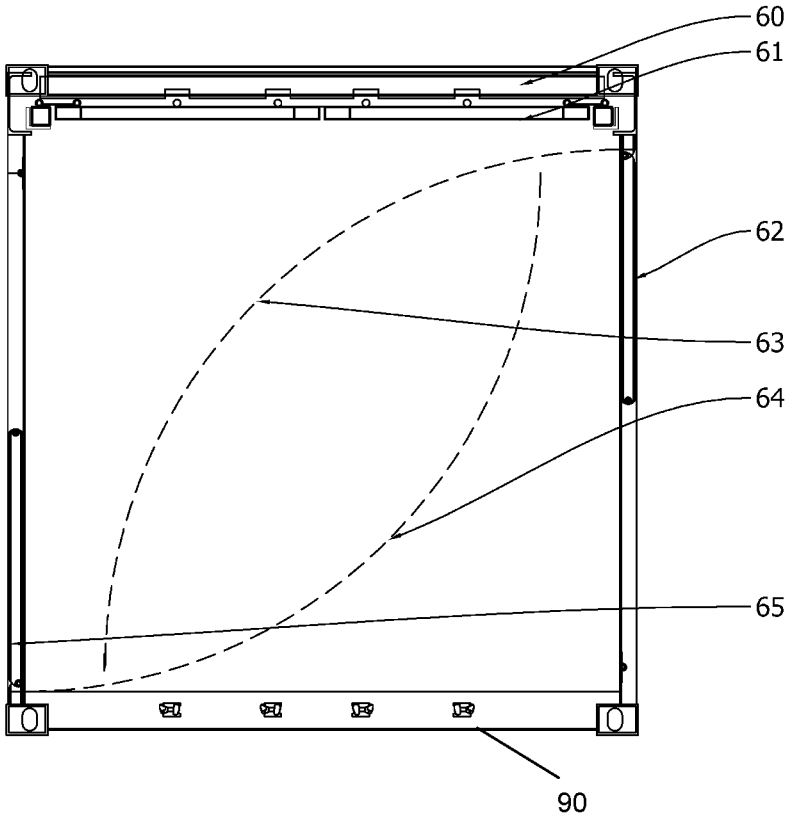
FIG. 2 is a schematic end view of a container according to an embodiment of the invention (a) in an erect configuration; (b) in a partially collapsed configuration; and (c) in a collapsed configuration.
Figure 2B:
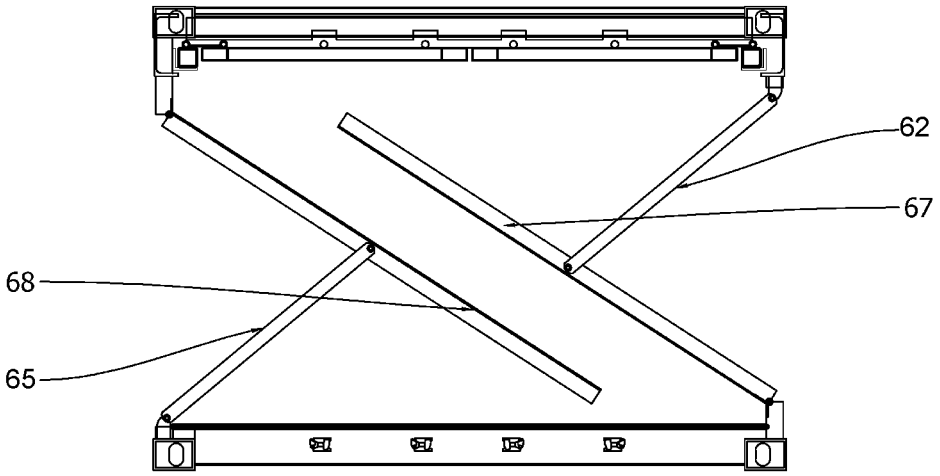
Figure 2C:
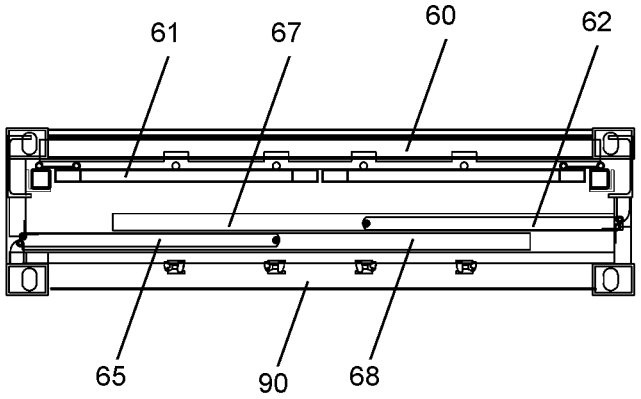

With regard to FIGS. 1-2, there is illustrated a collapsible intermodal container comprising a pair of side panels 67, 68, a pair of end panels 61, 92, a top panel 60 and a bottom panel 90. One of the end panels 61 includes doors 95 with standard locking rods 96 and handles 97.

The container is movable between an erect configuration in which the side panels and end panels are substantially perpendicular to the top and bottom panels, as illustrated in FIG. 1*a*, and a collapsed configuration in which the side panels and end panels are substantially parallel to the top and bottom panels, as illustrated in FIG. 1*c*.

In this embodiment one of the side panels 68 is hingedly connected to the top panel 60 and includes a strut 65 at both ends of the panel. One end of the strut 65 is pivotally connected at an intermediate point 93 along the edge of the panel 68, the other end of the strut is pivotally connected to the bottom panel 90.

Similarly, the other side panel 67 is hingedly connected to the bottom panel 90 and includes a strut 62 at both ends of the panel. One end of the strut 62 is pivotally connected at an intermediate point 94 along the edge of the bottom panel 90, the other end is pivotally connected to the top panel 60.

As such, starting from the collapsed configuration, when the top panel is lifted, the side walls are swung into an upright position, the struts holding the side panels away from the top and bottom panels during the movement into the erect configuration as illustrated in FIGS. 1*b* and 2*b*. The reverse movement is performed when the container is moved from the erect configuration to the collapsed configuration.

As shown in FIG. 2*a*, the top of the right panel traces an arc 63 is it is moved between erect and collapsed configurations. Similarly the bottom of the left panel traces an arc 64 relative to the top panel during such movement.

In this embodiment the end walls 61 are stored underneath the top panel 60, such that when the side walls have been erected and secured in the upright position, the top panel can be pulled out from the storage position as shown in FIGS. 1*b-c* and swung down into an upright position as shown in FIG. 1*a*. Standard locks, latches, and/or the like can then be used to hold the panels in position.

Figure 3:
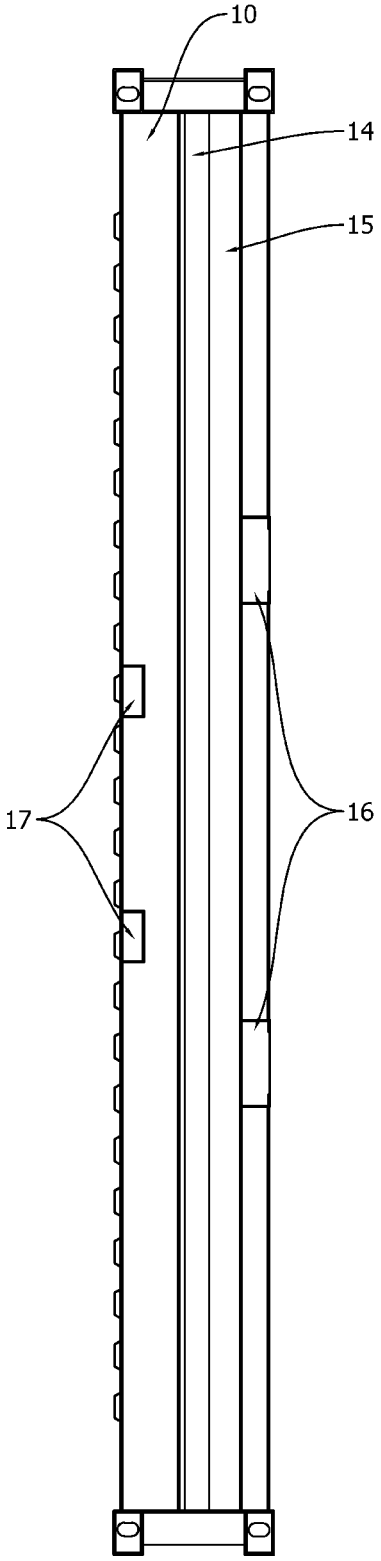
FIG. 3 is an schematic side view of a container according to an embodiment of the invention in a collapsed configuration.

With reference to FIG. 3, a side view of the collapsed configuration in illustrated, comprising the top area 10 which includes the top panel 60 and the storage area for the end panels 61,92, A frame seal 14 provides rigidity to the side panel and allows a better seal onto spacer 15, which provides a height differential between the two sides so that the side panels can overlap and lie flat when the container is collapsed. Standard fork lift pockets 16, 17 are also provided, into which a fork lift truck inserts its prongs to reconfigure or move the container.

Figure 4:
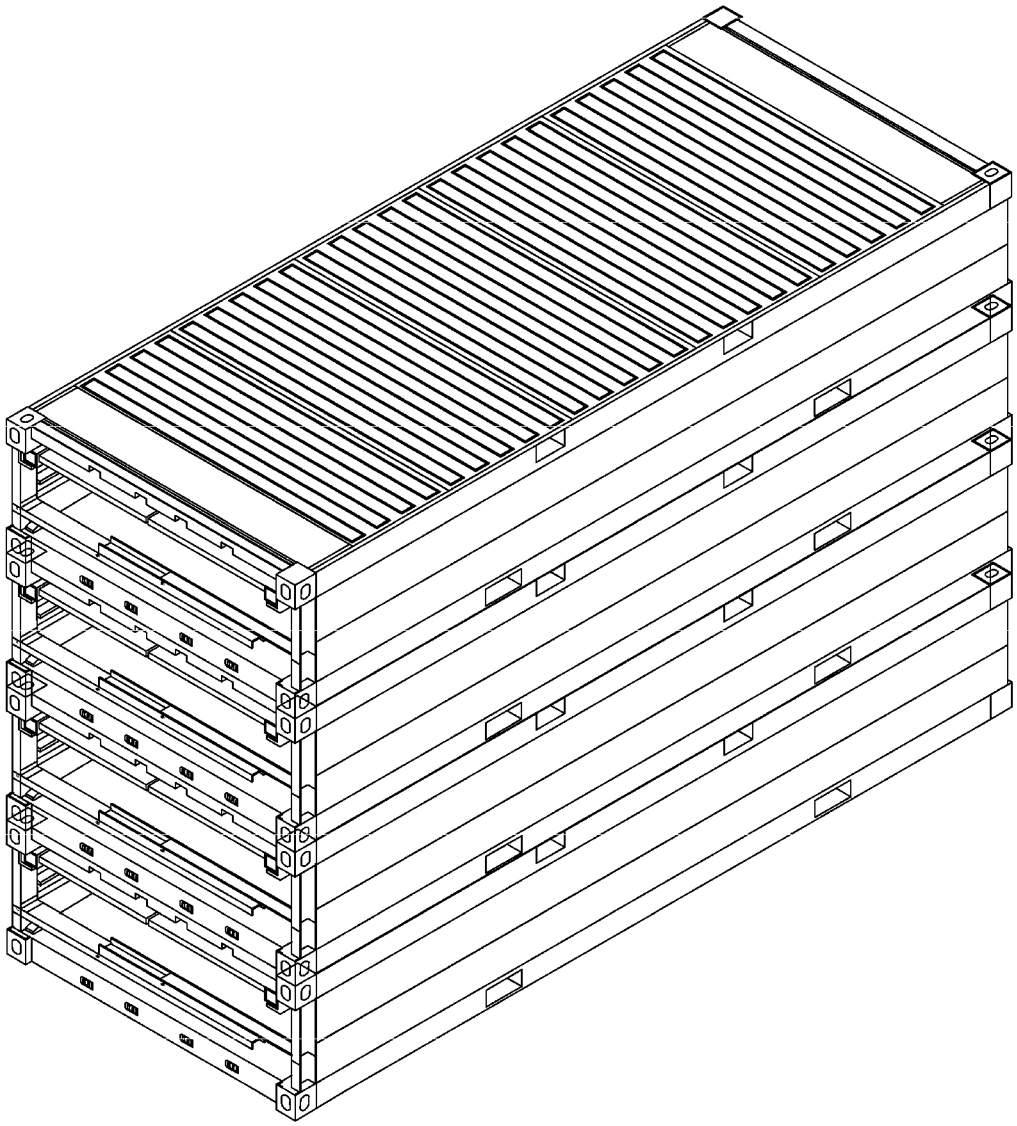
FIG. 4 is an isometric view of four stacked collapsed containers

With regard to FIG. 4, it can be seen that the collapsed containers can be easily stacked, and take up significantly less space in this configuration. Indeed, four collapsed containers take up the same space and can therefore be substituted directly for one erect container.

With reference to FIGS. 5*a-e*, the steps to move the end panel from the erect position to the storage position are illustrated.

In FIG. 5*a* the receiver 50 is up and the lock 51 is set such that the end panel 52 is secured. The receiver comprises rails, rollers or other movement means to allow the end panel to pushed in or pulled out of the top area 10 via the same. In FIG. 5*b* the lock is raised and the receiver 50 is lowered so that the end panel 52 can pivot away from the tang 56 which is a protrusion that acts as a door stop, fitting into a recess in the panel when the panel is in the use position. As shown in FIG. 5*c-d* the end panel continues to pivot along arc 58, moving into the top area 10 as the trajectory completes, as shown in FIG. 5*e*. The steps can be reversed to move the end panel from storage into a use position.

It will be appreciated by persons skilled in the art that the present invention may also include further additional modifications made to the system which does not affect the overall functioning of the system.

The invention claimed is:

1. A collapsible container comprising:

a pair of side panels, a pair of end panels, a top panel and a bottom panel;

the container being movable between an erect configuration in which the side panels and end panels are in a substantially perpendicular plane to the top and bottom panels, and a collapsed configuration in which the side panels and end panels are in a substantially parallel plane to the top and bottom panels;

characterised in that at least one of the pairs comprises hingedly connected panels wherein the hingedly connected pair of panels are the side panels, a first panel being hingedly connected to the top panel and includes at least one strut, one end of the strut being pivotally connected at an intermediate point along the end edge of said first panel, the other end of the strut being pivotally connected to the bottom panel, a second panel being hingedly connected to the bottom panel and includes at least one strut, one end of the strut being pivotally connected at an intermediate point along the end edge of said second panel, the other end of the strut being pivotally connected to the top panel;

such that when the container is moved between the collapsed configuration and the erect configuration, the struts support the hingedly connected panels in order to maintain a spaced apart relationship between the edges of the hingedly connected panels and the respective top or bottom panel.

2. The collapsible container according to claim 1 wherein each panel is maintained in a planar form when moved between erect and collapsed configurations.

3. The collapsible container according to claim 1 wherein a strut is provided at both ends of the hingedly connected panels.

4. The collapsible container according to claim 1 wherein the end panels can be slid or rolled into position between an erect configuration in which they are in a perpendicular plane to the top, bottom, and side panels, and a storage configuration in which they are in substantially the same plane as the top or bottom panel.

5. The collapsible container according to claim 4 wherein the end panels lie flat against or adjacent the top or bottom panel in the storage configuration.

6. The collapsible container according to claim 1 wherein the top and/or bottom panels are provided with a recess or receiving area in which the end panels may be stored.

7. The collapsible container according to claim 1 wherein at least one end panel is provided with doors through which access to the container may be granted when in the erect configuration.

8. The collapsible container according to claim 1 wherein at least one end panel comprises a roller shutter, which can be opened or closed to respectively provide or prevent access to the container.

9. The collapsible container according to claim 1 wherein fork lift pockets are provided in the top panel to allow a fork lift truck to raise and lower the same to move the container between erect and collapsed configurations respectively.

10. The collapsible container according to claim 1 wherein four containers in the collapsed configuration can be stacked to substantially equate to the same space as one container in the erect configuration.

11. The collapsible container according to claim 1 wherein four containers in the collapsed configuration can be locked together so that they can be moved and relocated in the same way as a single container.

12. The collapsible container according to claim 1 wherein the struts may be provided with hydraulic systems to allow the panels to be raised and/or lowered in a controlled fashion.

13. A collapsible container comprising:

a pair of side panels, a pair of end panels, a top panel and a bottom panel wherein at least one end panel of said pair of end panels comprises a roller shutter, which can be opened or closed to respectively provide or prevent access to the container;

the container being movable between an erect configuration in which the side panels and end panels are in a substantially perpendicular plane to the top and bottom panels, and a collapsed configuration in which the side panels and end panels are in a substantially parallel plane to the top and bottom panels;

characterised in that at least one of the pairs comprises hingedly connected panels, a first panel being hingedly connected to the top panel and includes at least one strut, one end of the strut being pivotally connected at an intermediate point along the end edge of said first panel, the other end of the strut being pivotally connected to the bottom panel, a second panel being hingedly connected to the bottom panel and includes at least one strut, one end of the strut being pivotally connected at an intermediate point along the end edge of said second panel, the other end of the strut being pivotally connected to the top panel;

such that when the container is moved between the collapsed configuration and the erect configuration, the struts support the hingedly connected panels in order to maintain a spaced apart relationship between the edges of the hingedly connected panels and the respective top or bottom panel.

14. A collapsible container comprising:

a pair of side panels, a pair of end panels, a top panel and a bottom panel;

the container being movable between an erect configuration in which the side panels and end panels are in a substantially perpendicular plane to the top and bottom panels, and a collapsed configuration in which the side panels and end panels are in a substantially parallel plane to the top and bottom panels;

characterised in that at least one of the pairs comprises hingedly connected panels, a first panel being hingedly connected to the top panel and includes at least one strut, one end of the strut being pivotally connected at an intermediate point along the end edge of said first panel, the other end of the strut being pivotally connected to the bottom panel, a second panel being hingedly connected to the bottom panel and includes at least one strut, one end of the strut being pivotally connected at an intermediate point along the end edge of said second panel, the other end of the strut being pivotally connected to the top panel;

such that when the container is moved between the collapsed configuration and the erect configuration, the struts support the hingedly connected panels in order to maintain a spaced apart relationship between the edges of the hingedly connected panels and the respective top or bottom panel; and wherein fork lift pockets are provided in the top panel to allow a fork lift truck to raise and lower the same to move the container between erect and collapsed configurations respectively.

* * * * *